US005558222A

United States Patent [19]

Volk et al.

[11] Patent Number: 5,558,222

[45] Date of Patent: Sep. 24, 1996

[54] TRAY FOR POULTRY TRUSSES

[76] Inventors: Donald J. Volk; Steve Martin, both of c/o Volk Enterprises, Inc. 1232 South Ave., Turlock, Calif. 95380

[21] Appl. No.: 502,365

[22] Filed: Jul. 13, 1995

Related U.S. Application Data

[63] Continuation of Ser. No. 263,460, Jun. 22, 1994, abandoned.

[51] Int. Cl.[6] ..... B65D 83/00

[52] U.S. Cl. ..... 206/338; 206/518; 206/564

[58] Field of Search ..... 206/505, 515, 206/518, 519, 520, 557, 561, 564, 338, 340

[56] References Cited

U.S. PATENT DOCUMENTS

| | | | |
|---|---|---|---|
| 3,589,511 | 6/1971 | Britt | 206/518 |
| 4,293,977 | 10/1981 | Volk et al. | 17/11 |
| 4,428,493 | 1/1984 | McDonough | 206/518 X |
| 4,518,083 | 5/1985 | Mayer, Jr. | 206/340 |
| 4,838,417 | 6/1989 | Jeruzal | 206/518 X |

*Primary Examiner*—Jacob K. Ackun

*Attorney, Agent, or Firm*—Joseph T. Regard, Ltd.

[57] ABSTRACT

A tray for retaining poultry trusses. The tray includes at least one longitudinally extending truss support having a first support structure for supporting the U-shaped central portion of a truss, first and second outward extending surfaces extending outwardly from the first support structure, and second support structures extending outwardly from the outward extending surfaces for supporting the truss legs. The first and second support structures are optionally shaped and dimensioned to support a poultry truss with the shoulders of the truss spaced above the outward extending surfaces. The tray optionally includes stacking members for stacking the tray above a second tray with the first-mentioned tray selectively positioned in a nested arrangement with an empty tray and spaced above a filled tray.

18 Claims, 1 Drawing Sheet

TRAY FOR POULTRY TRUSSES

This is a continuation of application Ser. No. 08/263,460 filed on Jun. 22, 1994, now abandoned.

BACKGROUND OF THE INVENTION

1. Field of the Invention

The present invention relates in general to a packaging system for shipping and storing poultry trusses. More particularly, the present invention relates to a storage tray for retaining several poultry trusses in an organized arrangement.

2. Background of the Invention

When preparing poultry for the market, the legs of the eviscerated bird are generally folded against the body and retained in place by a poultry truss such as the wire trussing device shown in U.S. Pat. No. 4,293,977, the disclosure of which is incorporated herein by reference. In general, the wire trussing device includes a central U-shaped portion, outward extending shoulders and a pair of legs depending from the shoulders. The disclosed poultry device engages the hocks of the poultry legs and securely trusses the legs against the body and across the rear opening of the bird. Advanced processing techniques have been developed to more quickly process the poultry. Providing a worker with convenient access to a supply of poultry trusses further improves the efficiency of poultry processing systems. Storing poultry trusses in an orderly arrangement within the convenient reach of the worker minimizes the time required for a worker to pick up a handful of trusses from the tray.

One type of storage cartridge available in the art is disclosed in U.S. Pat. No. 4,518,083. The disclosed cartridge includes a V-shaped section bordered by a pair of longitudinally extending ridges or corners. The V-shaped section is formed so that the truss may be positioned with the shoulders of the truss supported by the longitudinally extending ridges and the U-shaped portion positioned in the V-shaped section of the cartridge.

A storage tray which may be arranged in a stack with adjacent trays being spaced apart when the trays are filled with poultry trusses allows a worker to quickly pick up the top tray and remove it from the stack. While separating the trays is desirable when the trays are full, this stacking arrangement is of minimal advantage for empty trays. A storage tray which may also be stacked in a nested arrangement when the trays are empty minimizes the space occupied by the trays as well as the costs of shipping the empty trays.

Accordingly, a primary object of the present invention is to provide a tray for efficiently retaining a plurality of poultry trusses in an organized arrangement.

A further object of the present invention is to provide a tray for poultry trusses which retains the trusses in a substantially uniform, parallel arrangement.

A still further object of the invention is to provide means to prevent disarray of the trusses in an underlying tray when a superimposed tray is lifted.

Another object of the present invention is to provide a tray for poultry trusses which may be arranged in a stack with the tray spaced above a second tray when the second tray is filled with trusses.

Yet another object of the present invention is to provide such a tray for poultry trusses which may also be positioned in a stack with the tray nested in the second tray when the second tray is empty.

A more general object of the present invention is to provide a tray for poultry trusses which may be efficiently and inexpensively manufactured, which may be molded of an inexpensive plastic, and which holds a considerable quantity of poultry trusses.

SUMMARY OF INVENTION

The tray of the present invention, which is particularly suitable for retaining a plurality of poultry trusses, includes one or more parallel, longitudinally extending truss supports for supporting a plurality of trusses. Each truss support has a first support structure for supporting the central U-shaped portion of the truss and a pair of second or lateral support structures spaced outwardly from the first support structure for supporting the truss legs. The support structures are adapted so that the trusses are retained in an organized arrangement and positioned so that they may be easily removed from the tray.

In one modification of the invention, the truss support has first and second outward extending surfaces extending between the first support structure and the two second support structures. The support structures are shaped and dimensioned to position, poultry trusses retained within the tray with the shoulders of the trusses spaced above the outward extending surfaces of the truss support. Raising the truss shoulders above the outward extending surfaces ensures that the truss support retains the trusses in a substantially uniform, parallel arrangement.

The tray may optionally include stacking members for positioning several trays in a stack. The stacking members are preferably adapted to stack several empty trays in a nested arrangement to minimize the bulk of the stack during transport, handling and storage. After the trays have been filled poultry trusses, the stacking members support the trays so that the trays are spaced apart to provide sufficient space for a worker to easily remove the uppermost tray and separate the tray from the stack. Further, the trays retain the poultry trusses in the underlying trays and, by reason of the spacing of the trays, removing one tray does not disturb the arrangement of the trusses in the underlying tray.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Figure 3:
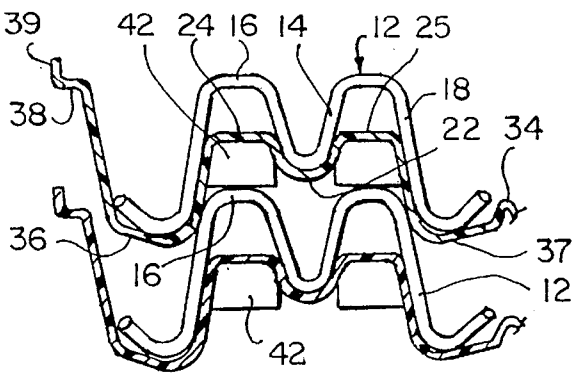
FIG. 3 is a cross sectional view taken along the plane of line 3—3 in FIG. 1, shown with the tray superimposed over a tray filled with poultry trusses.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

The preferred embodiment of a tray for poultry trusses in accordance with the present invention is shown in FIGS. 1–4. The tray 10 is particularly suitable for retaining a plurality of poultry trusses 12. As shown particularly in FIGS. 1 and 3, each truss 12 generally includes a U-shaped central portion 14, a pair of shoulders 16 extending outwardly from the U-shaped portion 14, and a pair of legs 18 depending from shoulders 16. The trusses are preferably formed of a stiff resilient metal wire or other material as for example a suitable plastic. Tray 10 includes at least one longitudinally extending truss support 20 for supporting a plurality of poultry trusses 12 in a nested arrangement. In the depicted embodiment, tray 10 includes three truss supports 20 although it should be understood that the number of truss supports may be increased or decreased as desired. Since the truss supports are substantially identical, only one truss support 20 will be described in detail.

Truss support 20 includes first support means for supporting the U-shaped portion of the poultry trusses. One such first support means is provided by a longitudinally extending central channel 22. The central channel is shaped to receive and support the tip of the U-shaped portion 14 of truss 12. Extending outwardly from the central channel 22 are first and second outward extending surfaces 24 and 25. The outward extending surfaces 24 and 25 may be substantially horizontal, as shown in the Figures, or they may have other orientations. Inner walls 27 and 28 depend from the outermost edge of outward extending surfaces 24 and 25 and terminate in lower surfaces 30 and 31. Spaced outwardly from the inner walls 27 and 28 are outer walls 33 and 34. The inner walls 27 and 28, lower surfaces 30 and 31, and outer walls 33 and 34 define a pair of longitudinally extending lateral channels 36 and 37. The lateral channels 36 and 37 provide second support means for supporting the legs 18 of the poultry truss.

Outer wall 33 preferably extends above truss support 20 as the wall 33 coincides with the peripheral wall of the tray while outer wall 34 is substantially shorter. The outer wall 34 separates adjacent truss supports and prevents the legs 18 of the trusses 12 in adjacent truss supports 20 from becoming tangled. The height of the outer walls may vary and, if desired, the height of outer wall 33 may be substantially decreased if a peripheral tray wall is not needed. The upper edge of the outer wall 33 terminates in a peripherally extending shoulder 38 and a vertical rim 39 upstanding from the shoulder 38. The peripheral shoulder 38 and rim 39 may be used by a worker to remove the tray 10 from a stack of trays.

Figure 1:
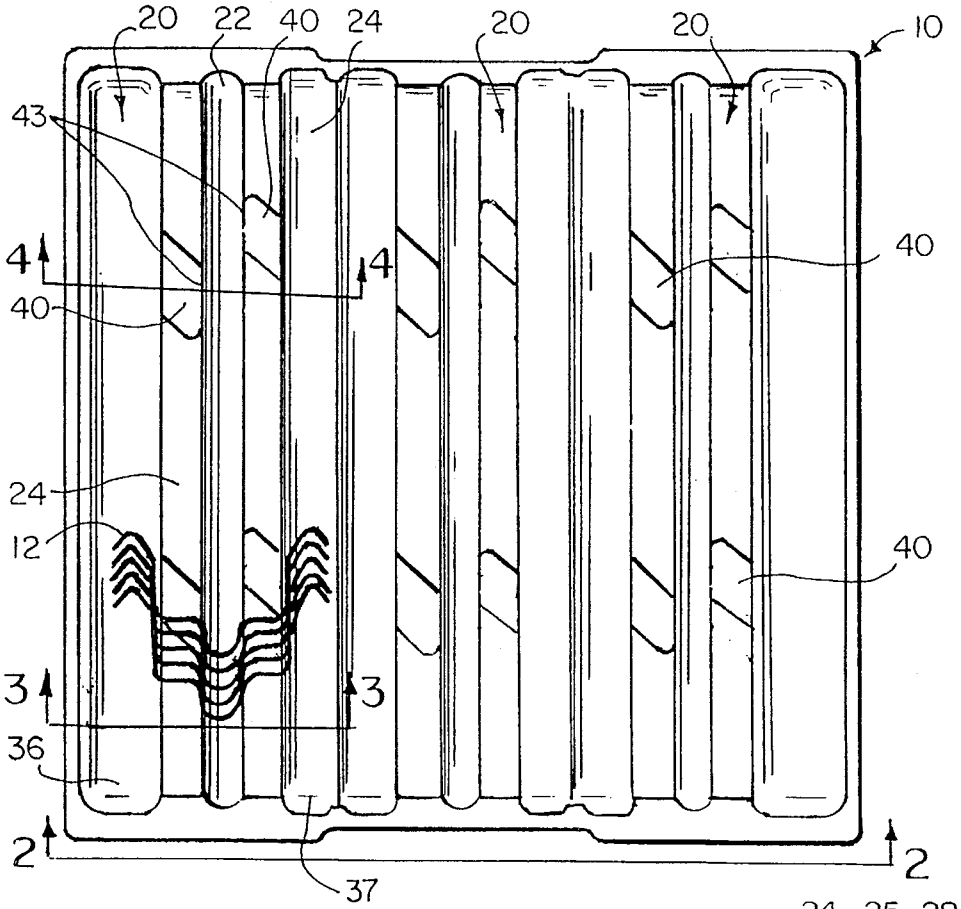
FIG. 1 is a top plan view of a tray in accordance with the present invention, shown with several poultry trusses retained therein.

As shown particularly in FIG. 1, central channel 22 and lateral channels 36 and 37 are shaped and dimensioned to position the poultry truss 12 with the U-shaped portion 14 having a substantially vertical orientation in the central channel and legs 18 inclined at an angle and extending away from the U-shaped portion. Providing the poultry trusses with the depicted orientation improves a worker's ability to remove the trusses by allowing the worker to simultaneously seize the central portion 14 of several trusses and remove them from the tray. The truss support retains the trusses in a uniform, substantially parallel orientation and is shaped so that the tip of the U-shaped portion 14 is supported by central channel 22, the lower portions of legs 18 are supported by lateral channels 36 and 37, and shoulders 16 are spaced above the outward extending surfaces 24 and 25. The actual distance separating the shoulders of each truss from the outward extending surfaces depends upon the specific dimensions of each individual poultry truss. Since the positioning of shoulders 16 accommodates variations in the truss dimensions, the substantially parallel orientation of the trusses will be maintained. Providing the trusses within the tray with a substantially parallel orientation minimizes the tendency of the legs of adjacent trusses to overlap and become tangled and disorganized.

Figure 4:
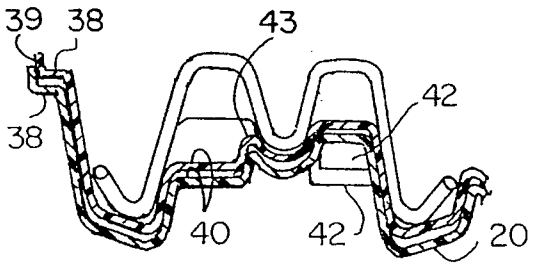
FIG. 4 is a cross sectional view taken along the plane of line 4—4 of FIG. 1, shown with the tray superimposed over an empty tray.
Figure 2:
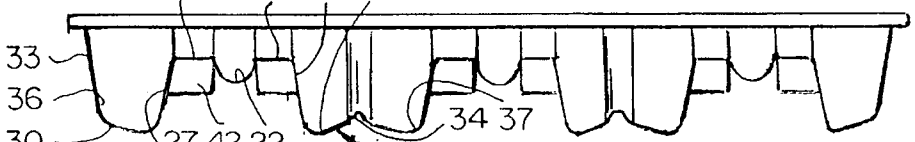
FIG. 2 is an end view taken along the plane of line 2—2 in FIG. 1.

Tray 10 preferably includes stacking means for selectively stacking a plurality of trays in either a nested arrangement or in a stack with the trays spaced apart. One such stacking means is provided by recessed portions 40 formed in truss supports 20 and foot portions 42 depending from the bottom of the tray. The recessed portions 40 and the foot portions 42 are cooperatively formed so that when several empty trays are arranged in a stack, the foot portion 42 of one tray seats in a recessed portion 40 in the lower tray. Preferably, the trays are configured so that the first tray nests almost entirely within the lower tray. As shown in the Figures, the foot portions 42 are positioned immediately below the recessed portions 40. Because of the slant and flexibility of the outer wall 33, the outer wall and vertical rim 39 of the upper tray fit within the outer wall and rim of the lower tray, with the peripheral shoulder 38 of one tray superimposed above the shoulder of the underlying tray. Thus, as is shown in FIG. 4, two nested trays occupy only slightly more space than one tray alone.

Although it is generally desirable to minimize the space occupied by empty trays, the accessibility of each tray is typically more important than the size of the stacks when the trays are filled with poultry trusses. When a tray is stacked on top of a filled tray, foot portion 42 of the upper tray engages the shoulders 16 of the poultry trusses in the filled lower tray to support the upper tray in a raised position relative to the lower tray. The space separating the two trays is of sufficient size to enable a worker to conveniently grasp the upper tray beneath the shoulder 38 and rim 39 and remove it from the stack. The separation between trays also allows the upper tray to be removed without disrupting the arrangement of the trusses in the lower trays. The trays 10 are configured so that they may be stacked in a secure, stable arrangement when filled with poultry trusses. The underside of the tray preferably follows the shape of the tray interior as shown in the Figures. When stacked, the shoulders 16 and the upper portion of legs 18 fit between the underside of inner walls 27 and 28 of the upper tray. The engagement between foot portions 42 and the inner walls of the upper tray and the trusses 12 in the lower tray prevents slippage of the trays and securely holds the trays in the stack. Further, the upper trays help retain the trusses in the underlying trays. The trays may be separated by simply lifting the top tray from the stack.

In the preferred form, the recessed portions 40 are formed in the outward extending surfaces 24 and 25. As shown particularly in FIG. 4, the recessed portion 40 is separated from the central channel 22 by an elevated ridge 43. When the tray is filled with trusses, the ridge 43 retains the U-shaped portion 14 in the central channel and prevents the U-shaped portion of the truss from slipping into the recessed portion 40. The recessed portions 40 are positioned in a staggered arrangement so that the recessed portion 40 formed in the outward extending surface 24 is not aligned with the recessed portion in outward extending surface 25. The ridges 43 and the position of the recessed portions 40 ensure that the trusses are held in an organized arrangement within the trays.

The cooperatively formed recessed portions 40 and foot portions 42 provide suitable stacking means for stacking the trays in two different positions depending upon whether the trays are empty or filled with the trusses. The recessed portions and the foot portions minimize the space occupied by a stack of empty trays and position the filled trays for convenient removal from the stack by a worker. In the depicted form, the recessed portions 40 are formed in the outward extending surfaces 24 and 25. Each truss support is formed with four recessed portions, with the recessed portions extending diagonally across the outward extending surfaces. The foot portions 42 depend from the underside of the tray immediately below the recessed portions so that each tray in the stack may be substantially aligned with the lower trays. It should be understood that the shape, position and number of recessed portions 40 and foot portions 42 may vary.

The tray of the depicted embodiment is fabricated of a suitable plastic such as polyethylene and is manufactured by an injection molding process. However, it should be understood that other suitable materials may also be used to form the tray of the present invention.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. In combination, a tray for retaining poultry trusses and a plurality of said trusses, said trusses having a U-shaped central portion, first and second shoulders extending outwardly from said central portion and a pair of legs depending from said shoulders, said tray comprising at least one longitudinally extending truss support having first support means for supporting said central portion of said trusses, first and second outward extending surfaces extending outwardly from said first support means, and second support means extending outwardly from said first and second outward extending surfaces for supporting said legs of said trusses, said first support means and said second support means supporting said trusses with said shoulders spaced above said outward extending surfaces.

2. The combination of claim 1 in which said first support means comprises a longitudinally extending central channel, central portion of said trusses being positioned in said central channel.

3. The combination of claim 1 in which said second support means comprises a pair of longitudinally extending lateral channels spaced outwardly from said first support means, said legs of said trusses being positioned in said lateral channels.

4. The combination of claim 1 in which said outward extending surfaces are substantially horizontal.

5. The combination of claim 1 in which said tray includes a plurality of said truss supports.

6. The combination of claim 1 in which said tray further comprises stacking means for stacking said tray above a second tray with said first-mentioned tray selectively positioned in a nested arrangement with said second tray when said second tray is empty and spaced above said second tray when said second tray is filled with a plurality of said trusses.

7. In combination, a tray for retaining a plurality of poultry trusses and a plurality of said trusses, said trusses having a U-shaped central portion, first and second shoulders extending outwardly from said central portion and a pair of legs depending from said shoulders, said legs having a distal portion spaced from said shoulders, said tray including at least one longitudinally extending truss support having an upper surface, first support means for supporting said central portion of said trusses and second support means spaced outward from said first support means for supporting said distal portion of said legs of said trusses, said first support means and said second support means supporting said trusses with said central portion retained at an elevated position relative to said distal portion of said legs and said shoulders of said trusses spaced from said upper surface of said truss support, and said tray including stacking means for stacking said tray above a second tray with said first-mentioned tray selectively positioned in a nested arrangement with said second tray when said second tray is empty and spaced above said second tray when said second tray is filled with a plurality of said trusses.

8. The combination of claim 7 in which said first-mentioned tray and said second tray each have a top surface and a bottom surface and in which said stacking means includes at least one recessed portion formed in said top surface and at least one foot portion depending from said bottom surface, said foot portion of said first-mentioned tray being shaped and positioned to seat within said recessed portion of said second tray when said second tray is empty and to engage a portion of said trusses retained within said second tray when said second tray is filled with a plurality of said trusses.

9. The combination of claim 8 in which said truss support has first and second outward extending surfaces extending between said first support means and said second support means and in which said at least one recessed portion is formed in at least one of said outward extending surfaces.

10. The combination of claim 8 in which said truss support further includes a ridge portion extending between said at least one recessed portion and said first support means.

11. The combination of claim 8 in which said recessed portion extends diagonally across at least a portion of said truss support.

12. The combination of claim 8 in which said foot portion is positioned immediately below said recessed portion.

13. The combination of claim 8 in which said stacking means includes of plurality of said recessed portions and a plurality of said foot portions.

14. The combination, of claim 7 and said second tray, said stacking means stacking said first-mentioned tray above said second tray with said first-mentioned tray nested within said second tray.

15. The combination, of claim 7 and said second tray, said second tray having a plurality of said trusses retained therein, said stacking means stacking said first-mentioned tray above said second tray with said first-mentioned tray spaced above said second tray.

16. The combination of claim 7 in which said first support means comprises a longitudinally extending central channel formed in said truss support and said second support means comprises a pair of longitudinally extending lateral channels spaced outward from said central channel.

17. The combination of claim 7 in which said truss support has first and second outward extending surfaces extending between said first support means and said second support means, said first support means and said second support means supporting said trusses with said shoulders spaced above said outward extending surfaces.

18. In combination, a tray for retaining poultry trusses and a plurality of said trusses, said tray including at least one truss support having a longitudinally extending central channel, a pair of longitudinally extending lateral channels spaced outwardly from said central channel, and first and second outward extending surfaces extending between said central channel and said lateral channels, said trusses having a U-shaped central portion positioned in said central channel, first and second shoulders extending outwardly from said central portion, and a pair of legs depending from said shoulders and extending into said lateral channels, said central channel and said lateral channels of said truss support supporting said trusses with said central portion of said trusses retained at an elevated position relative to a lowermost portion of said legs and said shoulders of said tresses spaced from said outward extending surfaces.

* * * * *